US005084929A

United States Patent [19]

Staudinger

[11] Patent Number: 5,084,929

[45] Date of Patent: Feb. 4, 1992

[54] BED SHEET SLEEPING ENCLOSURE

[76] Inventor: Luana A. Staudinger, 504 San Nicholas Ct., Laguna Beach, Calif. 92651

[21] Appl. No.: 741,687

[22] Filed: Aug. 7, 1991

[51] Int. Cl.[5] ..... A47G 9/04

[52] U.S. Cl. ..... 5/494; 5/496

[58] Field of Search ..... 5/494, 500, 502, 496, 5/497, 498, 495

[56] References Cited

U.S. PATENT DOCUMENTS

| | | | |
|---|---|---|---|
| 1,368,582 | 2/1921 | Stevens | 5/494 |
| 2,641,749 | 2/1949 | Mallette | 5/494 |
| 2,662,234 | 12/1953 | Citron | 5/496 |
| 3,083,378 | 4/1963 | Pursell | 5/494 |
| 3,521,309 | 7/1970 | Evans | 5/494 |
| 3,857,124 | 12/1974 | Madley | 5/494 |
| 3,962,739 | 6/1076 | Crocket | 5/496 |
| 4,035,854 | 7/1977 | Pardee | 5/497 |
| 4,413,368 | 11/1983 | Schuetze | 5/494 |

*Primary Examiner*—Alexander Grosz
*Attorney, Agent, or Firm*—Hawes & Fisher

[57] ABSTRACT

A sleeping enclosure, which keeps a sleeping child covered throughout the night, is constructed from a bottom form-fitted sheet for a mattress with a top flat sheet stitched to the bottom form-fitted sheet along the foot end portion and partially along the longitudinal sides. A cooperating fastening element removably secures the upper unstitched portions of the top flat sheet to the bottom form-fitted sheet. An elastic strap connected to both sides of the bottom form-fitted sheet slides under the mattress to keep the bottom form-fitted sheet from pulling away from the mattress. The result is an enclosure inviting a child to snuggle.

8 Claims, 3 Drawing Sheets

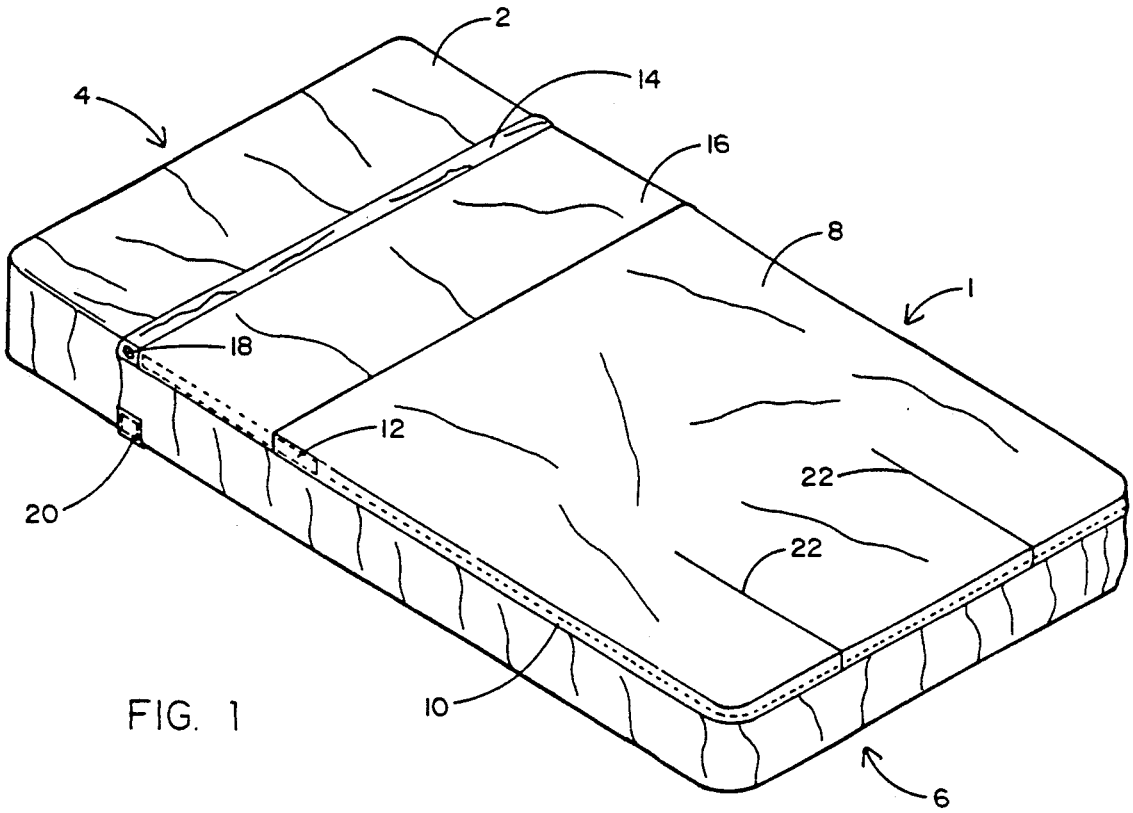
FIG. 1
FIG. 2
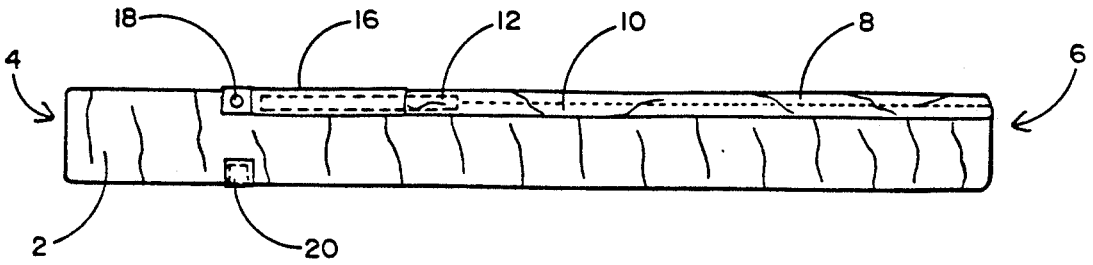

BED SHEET SLEEPING ENCLOSURE

BACKGROUND OF THE INVENTION.

1. Field of the Invention

This invention relates to a structure useful in keeping a sleeping person covered throughout the night. It is useful in keeping sheets and blankets properly placed on the bed and not sliding to the side or bottom of the bed.

2. Background Art

Sleeping children, in particular toddlers, always seem to end up uncovered and exposed to varying temperatures throughout the night. Their beds never seem to stay assembled.

An example of an approach to this problem is given in the U.S. Pat. to Schuetze (No. 4,413,368). A combination bedspread and sleeping enclosure, the bedspead being made to form fit the associated mattress and including a transversely disposed fastening element whereby a cooperating fastening element, is secured to the sleeping enclosure so as to be removably interconnected to the transverse fastening element of the bedspread. The sleeping enclosure has one end closed and two closed sides. The sleeping enclosure eliminates the need for the typical sheets and blankets presently employed for bedding as well as a separate spread or bed cover.

While this overcomes the typical problems of bedmaking by providing a combination bedspread and sleeping enclosure requiring a minimal amount of bedding, it does not solve the problem of keeping the covers around a sleeping child.

SUMMARY OF THE INVENTION

The bed sheet sleeping enclosure of the present invention consists of a bottom form-fitted sheet with an attached top flat sheet. Fastening means are provided to removably attach the top flat sheet against the bottom form-fitted sheet for a fraction of the length of the side. Means are provided so that the bottom form-fitted sheet will not easily pull away from the covered mattress.

The object of the present invention is to provide an effective way of preventing blankets and sheets from ending up on the bottom or side of the bed. Another object is to provide a way to make going to bed easy instead of the night's tragedy for children. A further object of the invention is to provide a child the illusion of camping out or of being at a slumber party through the appearance of a sleeping bag. A final object of the invention is to provide psychological comfort for a child by allowing the child to snuggle deeply within an enclosure.

BRIEF DESCRIPTION OF THE DRAWINGS

The invention will be further described in connection with the accompanying drawings in which:

FIG. 1 is an isometric view of a preferred bed sheet sleeping enclose of the present invention fully assembled;

FIG. 2 is a side elevational view of the bed sheet sleeping enclosure;

DETAILED DESCRIPTION

Figure 1A:
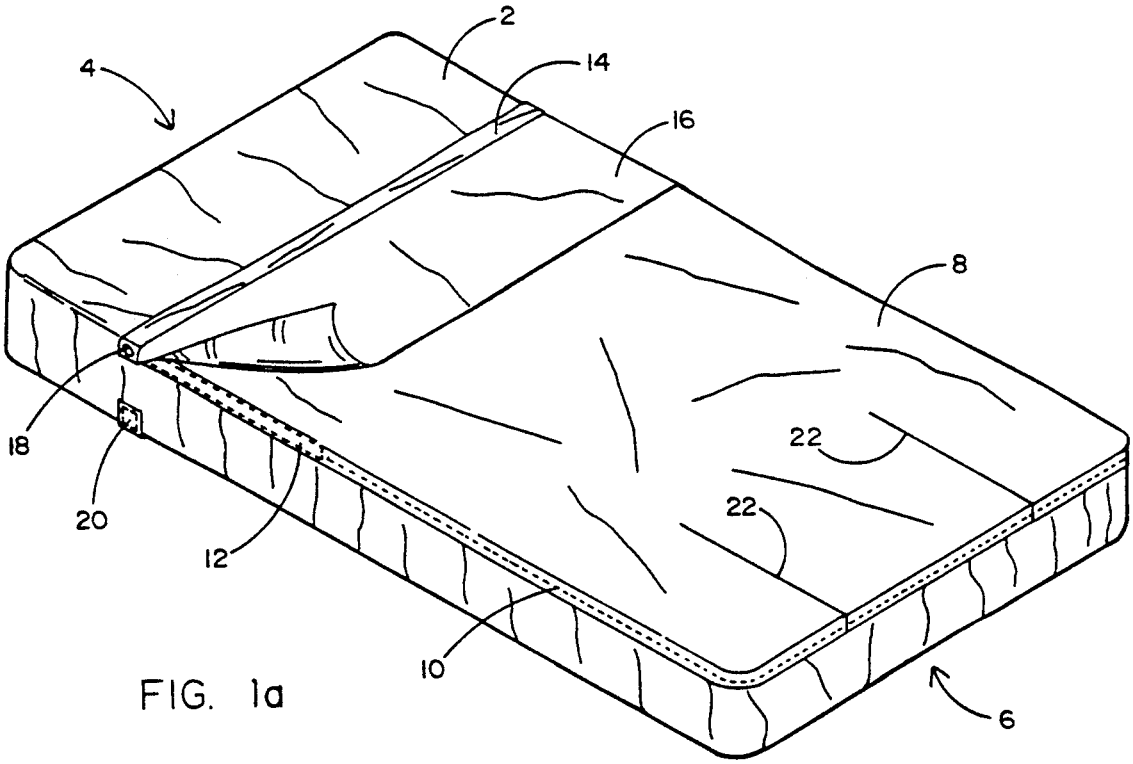
FIG. 1*a* is an isometric view of the bed sheet enclosure with the top flat sheet turned partially back.

The bed sheet sleeping enclosure of the present invention, in its preferred form, consists of a colorfully designed bottom form-fitted sheet having a top flat sheet sewn along the foot end and approximately ½ of the way up the sides. Commonly it will be used for sleeping by toddlers or young children, particularly those who have a tendency to toss and throw their covers off during the night.

As shown in FIG. 1, the bed sheet sleeping enclosure 1 comprises a bottom form-fitted sheet 2 which is designed to fit easily over a mattress. The shorter transverse ends of the form-fitted sheet are the open head end 4 and the closed foot end 6. A top flat sheet 8 is coupled to the bottom form-fitted sheet 2 by stitching 10 running transversely across the closed foot end 6 and approximately half way up each side of the bottom form-fitted sheet 2. On either side of the bottom form-fitted 2 sheet toward the open head end 4 from where the stitching 10 terminates are fastening means 12 which preferably comprises the well known male and female coupling members formed from elongated fabric strips preferably of Velcro. These male and female coupling members are attached one to the bottom form-fitted sheet 2 and the other to the top flat sheet 8. Running transversely near the open head end 4, but allowing room for a pillow, is a top elastic strap 14.

The top flat sheet 8 is folded over the top elastic strap 14 and stitching is provided to hold the top elastic strap 14 within the top flat sheet 8. The remaining portion of the top flat sheet 8 folds over and back upon itself to create a top flap 16. Additionally, snaps 18 are provided on either side attached to both the top flat sheet 8 and the bottom form-fitted sheet 2 so that the two sheets may be snapped together at the top. Running transversely under the bottom of the mattress is a bottom elastic strap 20 which is connected to the bottom form-fitted sheet 2 on both sides of the mattress. Finally, in the top flat sheet 8 near the closed foot end, pleats 22 are provided to give extra foot room.

In FIG. 1*a*, the top flap 16 has been folded back to completely expose the fastening means 12 running along the side between the bottom form-fitted sheet 2 and the top flat sheet 8. Also depicted are the snaps 18 which may hold the top flat sheet 8 to the bottom form-fitted sheet 2. Undoing the snaps 18 on either side allows a person to just pull apart the Velcro strips and easily extricate himself from the sleeping enclosure. Thus, in the middle of the night, it is easy for a child to get out of the bed sheet sleeping enclosure 1 and then later return to and close the enclosure to resume a comfortable sleep. The foregoing may be accomplished by touch. No lighting is needed; it can be done completely in the dark.

It can be seen in FIG. 2 that the top flat sheet 8 does not come down over the entire side of the bottom form-fitted sheet 2. The bottom elastic strap 20 located either directly under the snaps 18 or slightly toward the closed foot end 6. This bottom elastic strap 20 functions to keep the bottom form-fitted sheet 2 snugly around the mattress. It can be seen that the top flap 16 does not completely cover the fastening means 12. The stitching 10 can be followed from the closed foot end 6 all the way up and terminating before the fastening means 12 begins. Thus, the child can get in and out easily, and the sheets still remain attached to one another.

Figure 3:
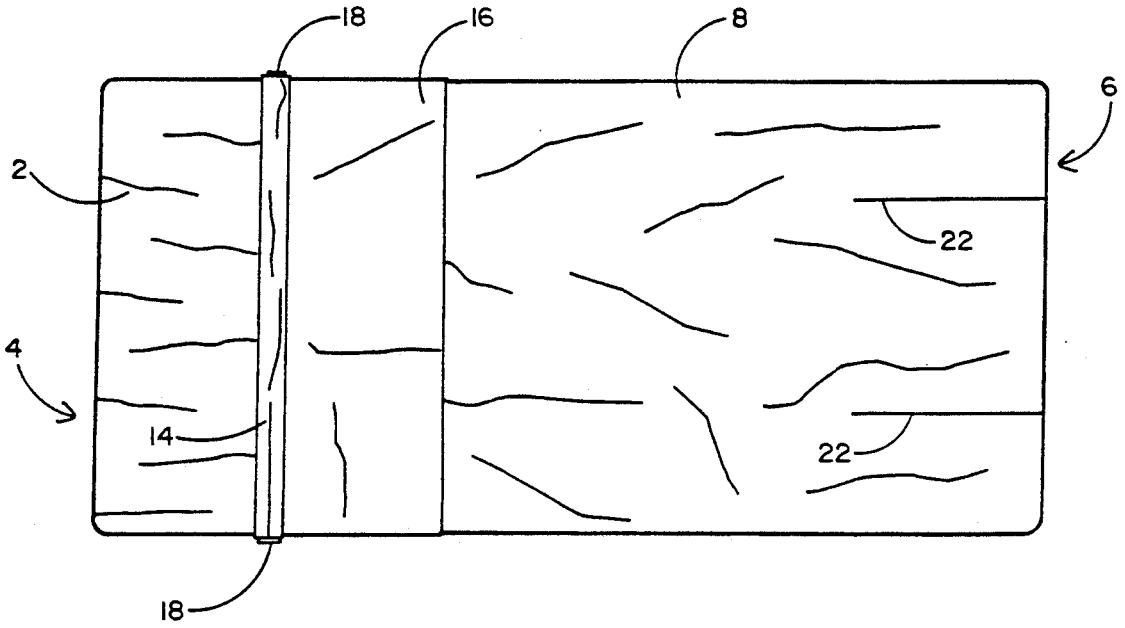
FIG. 3 is a top plan view of the bed sheet sleeping enclosure.

Viewing the bed sheet sleeping enclosure 1 from the top as in FIG. 3, the two pleats 22 at the closed foot end 6 provide extra foot room. A child has freedom for motion or turning over. The top elastic strap 14 which extends transversely across the top flat sheet 8 traverses the mattress at such a distance from the open head end 4 so that a pillow and a child's head have plenty of room. If a blanket were to be placed on top of the top flat sheet 8, then the top flap 16 would fold over the top of the blanket as is generally done in regular bedding.

Figure 4:
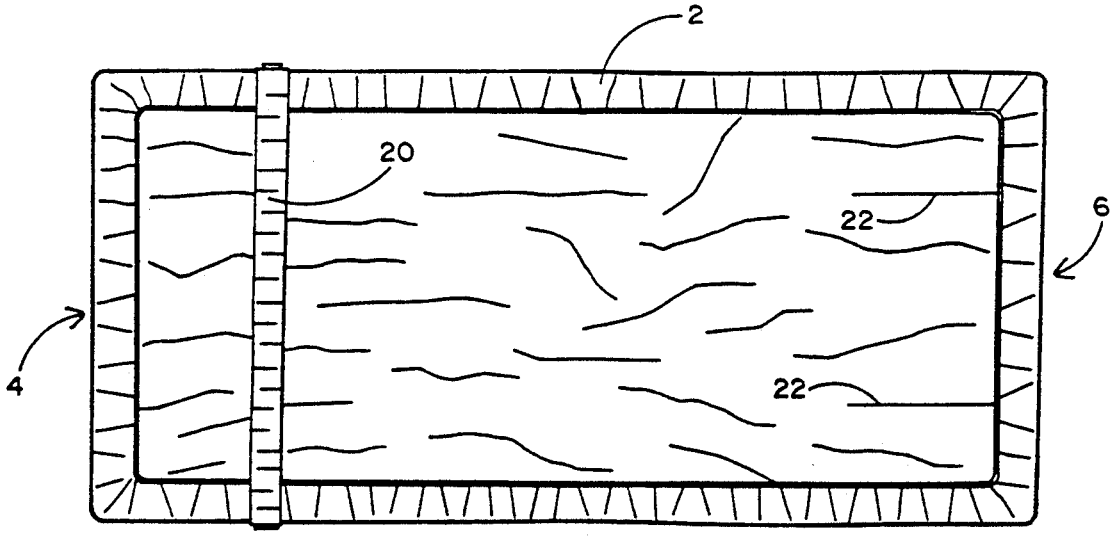
FIG. 4 is a bottom plan view of the bed sheet sleeping enclosure.

In FIG. 4, the bottom elastic strap 20 is shown stretching across from one side of the bottom form-fitted sheet 2 to the other side of a bottom form-fitted sheet. The placement of the bottom elastic strap 20 close to the open head end and almost directly below the snaps 18 holds the bottom form-fitted sheet 2 around the mattress even when a child is tossing and turning causing pulling on the snaps or releasing the fastening means 12 holding the top flat sheet 8 to the bottom form-fitted sheet 2.

Thus, the bed sheet sleeping enclosure closes both sides without confining the child. The bed sheet sleeping enclosure keeps restless sleepers covered by eliminating the usual shifting and slipping of bedding. The top flat sheet and the bottom form-fitted sheet are sewn together along their contacting edges half to two-thirds the distance along the longitudinally sides. The free open end of the top flat sheet defines the open head end of the enclosure. If a child wishes to be substantially enclosed between the bed sheets, the child fastens the mating longitudinal fastening means and snaps shut the snaps. It is contemplated that the fabric utilized for the bottom form-fitted sheet and the top flat sheet be comprised of any suitable material that can be color and design coordinated. It is further contemplated that a matching pillow case will be incorporated as part of the complete bed set.

The Velcro serves as easy access in and out of bed when needed such as if the child is potty trained. The snaps serve to reinforce the Velcro. The strap of elastic attached to the bottom of the form-fitted sheet gives the snap and Velcro more reinforcement. It also keeps the bottom form-fitted sheet from pulling out on the sides. The top flat sheet has the elastic band going across from snap to snap to hold the covers snug to the child with a slight restraint which will prevent the child from sliding out during his sleep. The upper sheet has two pleats at the closed foot end so that the top flat sheet will lay flat on the bed when it is made. Having the top flat sheet and the bottom form-fitted sheet stay in place will also make the blankets or comforter stay in place too. In this way the child will stay warm and snug throughout the night. Assembling the bed with the bed sheet sleeping enclosure is easy because there is only one sheet, not two. The process of lifting the top portion of the mattress for the bottom form-fitted sheet, sliding the elastic band down, pulling the rest of the sheet to the foot portion, and fitting the elastic to the mattress is a simple process. In contrast, conventional sheets require a process taking up to five steps.

Various modifications will be apparent to, and may be preferred by, others having ordinary skill in designing and fabricating such articles. Therefore, the disclosed embodiment of the bed sheet sleeping enclosure cannot be construed as limiting the invention; its scope is set forth in the following claims.

I claim:

1. A bed sheet sleeping enclosure comprising:

a bottom form-fitted sheet;

a top flat sheet attached by stitching along the bottom edge thereof and partially along the side edges to said bottom form-fitted sheet;

means for transversely keeping the top flat sheet taut to slightly restrain a sleeping individual from sliding out while sleeping, said means for slightly restraining the sleeping individual including an elastic band extending transversely through the end of the top flat sheet nearest the heat of the sleeping individual, said elastic band being limited to extend between the side edges of said top flat sheet; and means for removably fastening the unattached portion of said side edges of said top flat sheet to said bottom form-fitted sheet.

2. A bed sheet sleeping enclosure as set forth in claim 1 in which said male and female coupling members include strips of Velcro.

3. A bed sheet sleeping enclosure as set forth in claim 1 in which said means for removably fastening the partially unstitched sides to said bottom form-fitted sheet includes means for snapping said top flat sheet to the bottom form-fitted sheet.

4. A bed sheet sleeping enclosure as set forth in claim including means for securing the bottom form-fitted sheet from being easily removed from the mattress.

5. A bed sheet sleeping enclosure as set forth in claim 4 in which means for securing the bottom form-fitted sheet from being easily removed from the mattress includes an elastic strap passing under the mattress centered under the end of the top flat sheet nearest the head of a sleeping individual.

6. A bed sheet sleeping enclosure as set forth in claim 1 including means for enlarging the foot room within the sleeping enclosure.

7. A bed sheet sleeping enclosure as set forth in claim 6 in which means for enlarging the foot room within the sleeping enclosure includes forming pleats in the top flat sheet.

8. A bed sheet sleeping enclosure as set forth in claim 1 in which the top flat sheet is continuously attached along its bottom edge and at least one-half way up from the bottom edge along the side edges to said bottom form-fitted sheet.

* * * * *